United States Patent [19]

McCavey

[11] Patent Number: 4,953,598

[45] Date of Patent: Sep. 4, 1990

[54] WIRE TYING TOOL FOR CONCRETE REINFORCING STEEL

[76] Inventor: William M. McCavey, 1830-C Ashborough Ct., Marietta, Ga. 30067

[21] Appl. No.: 337,484

[22] Filed: Apr. 13, 1989

[51] Int. Cl.[5] ..... B21F 9/02

[52] U.S. Cl. ..... 140/57; 140/93.6; 140/119

[58] Field of Search ..... 140/57, 93 A, 93.6, 140/119

[56] References Cited

U.S. PATENT DOCUMENTS

| | | | |
|---|---|---|---|
| 3,211,187 | 10/1965 | Paule et al. . | |
| 3,391,715 | 6/1968 | Thompson | 140/93.6 |
| 3,428,096 | 2/1969 | Krylov et al. . | |
| 3,587,668 | 7/1971 | Ward | 140/93.6 |
| 3,590,885 | 7/1971 | Ward | 140/93.6 |
| 3,593,759 | 7/1971 | Wooge | 140/93.6 |
| 3,880,204 | 4/1975 | Sarff | 140/93 A |
| 4,117,872 | 10/1978 | Gott et al. | 140/119 |
| 4,141,389 | 2/1979 | Gottel | 140/93 |
| 4,177,842 | 12/1979 | Dilley | 140/93.6 |
| 4,354,535 | 10/1982 | Powell | 140/93 |
| 4,362,192 | 10/1982 | Furlong | 140/119 |
| 4,498,506 | 2/1985 | Moody et al. | 140/93.2 |
| 4,559,977 | 10/1985 | Dilley | 140/93.6 |
| 4,577,554 | 3/1986 | Brouse | 140/93.6 |
| 4,655,264 | 4/1987 | Dilley | 140/93.6 |
| 4,685,493 | 8/1987 | Yuguchi | 140/57 |

*Primary Examiner*—Lowell A. Larson

*Attorney, Agent, or Firm*—Thomas & Kerr

[57] ABSTRACT

A handheld power tool for making wire ties about elongate members of the type encountered in reinforced concrete construction. The tool is comprised of a body which encompasses the machinery, above electrical logic circuitry to control the component moters, switches, and other components. Midway in the housing the device feeds wire through feed rollers and through a wire guide at the bottom of the housing which directs the wire about the members that are to be tied together. The wire continues to be fed through a circular turet to which are mounted two side-by-side clamping jaws—one which will clamp the "dead" end of the wire while the feed wheels reverse their direction to take slack out of the wire and initially tighten it about the bars. The feed wheel assembly then transiates to a position that aligns the "live" end of the wire being fed between the second (side-by-side) jaw where it is clamped and cut. The turret and attached jaws then rotate (after the feed wheel assembly is moved out of the way), which accomplishes the desired task of making a wire tie about the concrete reinforcing bars. The components then return to their beginning positions and another cycle of operation is ready to begin.

11 Claims, 8 Drawing Sheets

WIRE TYING TOOL FOR CONCRETE REINFORCING STEEL

BACKGROUND

1. Field of Invention

This invention relates to the art of wire working and ties of such required around steel reinforcing bars in concrete structures.

2. Description of Prior Art

The present invention may have many applications. The uses of said invention should not be limited to those specifically set forth in the following disclosure.

Wire ties around steel reinforcing bars have been made by manual means using handheld pliers. This causes great worker fatigue and injuries due to repetitive movement syndrome. There has been a long felt need to mechanize this process and work for the reasons mentioned above and also a lessening of fatigue will result in increased production and hence lower costs in performing the operations of making ties about steel reinforcing bars used in concrete structures. Many prior attempts have been made to design devices to perform the function of making wire ties for said steel bars used as reinforcing in concrete structures, but these prior designs have not been commercially successful due to their heavy weight and many precision parts, which are expensive and slow the machine cycle time and are awkward due to the means of being powered.

Prior art in U.S. Pat. No. 3,211,187 to K. Paule, et.al., Oct. 12, 1965, shows complex heavy mechanical controls. Similarly, the patent issued to James E. Ward, U.S. Pat. No. 3,587,688 Jun. 28, 1971, entails a device which utilizes fluid pressure as a driving force which requires many heavy, slow parts to function. Similar prior art U.S. Pat. No. 4,117,872 to Hans Gott, et.al., of Austria, Oct. 3, 1978, is improved but still requires heavy mechanical linkages and externally rotating parts (jaws) which are dangerous and may injure the operator or catch on an obstruction, interrupting the machine's cycle, compared to the present embodiment of the proposed invention which has no externally exposed parts.

Another prior art reference is U.S. Pat. No. 4,362,192 to Donn B. Furlong, et.al., issued Dec. 7, 1982. In this machine, constant rotation of much of the drive mechanisms consume high quantities of energy. Also, the configuration and small size of the clamping and cutting jaw openings would require precise placement and guidance of the wire. This is difficult to achieve due to the stiff nature of the wire which tends to link and deform—making it impossible to precisely guide through small openings.

Further prior art disclosed is the U.S. Pat. No. 4,354,535 to Robert Y. Powell, et.al., dated Oct. 19, 1982, again utilizing heavy pneumatic drive means and many moving parts which wear and are slow in movement.

Additional prior art reference is Forest M. Sarff, et.al., U.S. Pat. No. 3,880,204 issued Apr. 29, 1975. This device entails many mechanical moving parts.

OBJECTS AND ADVANTAGES

The present embodiment of the invention disclosure provides a lightweight, fast, portable and economical method of attaining the goal of automating the process of making wire ties about steel reinforcing bars used in concrete structures. Great economies of manufacture of this device will result due to the many components which are presently commonly available through catalog suppliers and only a very few components which are custom manufactured. This is due to the unique and previously undiscovered details which are incorporated in the preferred embodiment of the invention. Lightweight, economical integrated circuits and composite plastic materials are used extensively due to the unique construction of the invention which heretofore was not discovered and entails fewer moving parts than any previously disclosed prior art.

Accordingly, several objects and advantages of my invention are: portability due to lightweight construction because many moving parts have been eliminated which were used for control and timing of the sequencing and machine operation. The preferred embodiment of the invention uses light, low cost and dependable electronic integrated circuits, electronic limit switches, electronic solenoids and motors all of which are conventional in construction and readily available through many catalog suppliers presently.

The unique features of the invention provide fast and efficient means for making tight, strong wire ties with a minimum of wire wasted in the process by locating the cutter very close to the tie. Furthermore, it provides adjustable means to further meter amounts of wire fed and further reduce waste. Because of these unique features, the invention will be a dependable, light, low cost and efficient machine which will enable even unskilled workmen to operate, and furthermore, the previously undiscovered details of the present embodiment of the invention yield a tool which is fast, efficient and economically attractive for commercial production. Additionally claimed objects and advantages are a safe, lightweight tool with few and lightweight moving parts.

Readers will find further objects and advantages of the invention from a consideration of the ensuing description and the accompanying drawings:

DRAWING REFERENCE NUMERALS:

12-Left Housing Side Cover
14-Wire Supply Reel
16-Right Jaw Closing Solenoid
17-Left Jaw Closing Solenoid
18-Connector Shaft
20-Thrust Shaft
22-Jaw Clamp and Cutter Head
23-Left Clamping Head
24-Fixed Jaw Boss
26-Fixed Jaw Trust Head
28-Wire Channel Guide Rotation Drive Gear
29-Drive Motor
30-Shaft Mount for 14
32-Drive Motor for Turret Rotation
34-Turrent Gear Drive Shaft
36-Drive Gear for Turret Rotation
38-Turret Gear
40-Commutator Ring
42-Wire Channel Guide
44-Electronic Logic Control Circuitry
46-Right Housing Side cover
48-Slider Solenoid Mounting Bracket
50-Moveable Wire Feed Assembly Slider Solenoid
52-Threaded Adjustable Connecting Link
54-Connecting Flange
56-Screws
58-Connecting Screws
60-(Left) Slider Guide 62-Idler Shaft for Wire Feed Driving Wheel
64-Driven Adjustable Feed Wheel Shaft
66-Wire Feed Driving Wheel
68-Driven Adjustable Feed Wheel
70-Drive Wheel Pressure Adjustment Screw
72-Drive Wheel Pressure Adjustment Thrust Frame
73-Wheel Tension Adjuster Tray
74-(Right) Slider Guide
76-Electric Trigger Mechanism
78-Moveable Wire Feed Mechanism Assembly
80-Trigger Mounting Shaft
82-Jaw Assembly (consists of several components)
84-Turret Realignment Flux Proximity Detector
86-Wire Feed Path (not part of invention)
94-Thrust Rod
96-Fixed Electric Brush
98-Mount (to connect 96 to 46)
104-Electrical Wire Connector
106-Wire Feed Reversible Driving Motor
108-Moveable Wire Guide Fence
110-Mounting Screws for 108
112-Replaceable Hardened Cutter Head
114-Replaceable Knurled Jaw Grips
116-Jaw Mounts

DRAWING FIGURE

DESCRIPTION

Figure 1:
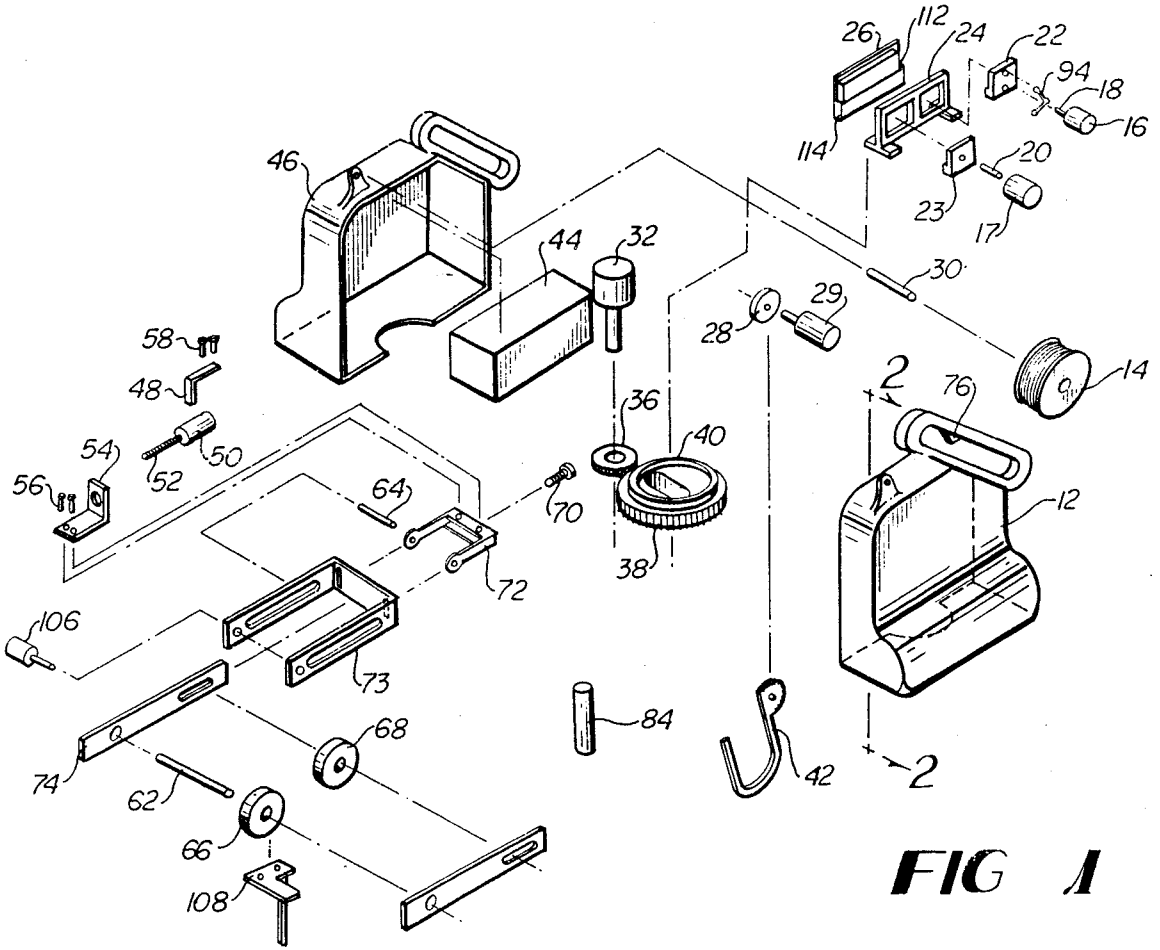
FIG. 1 Shows an exploded isometric view of the wire tying device in accordance with the invention.
Figure 4:
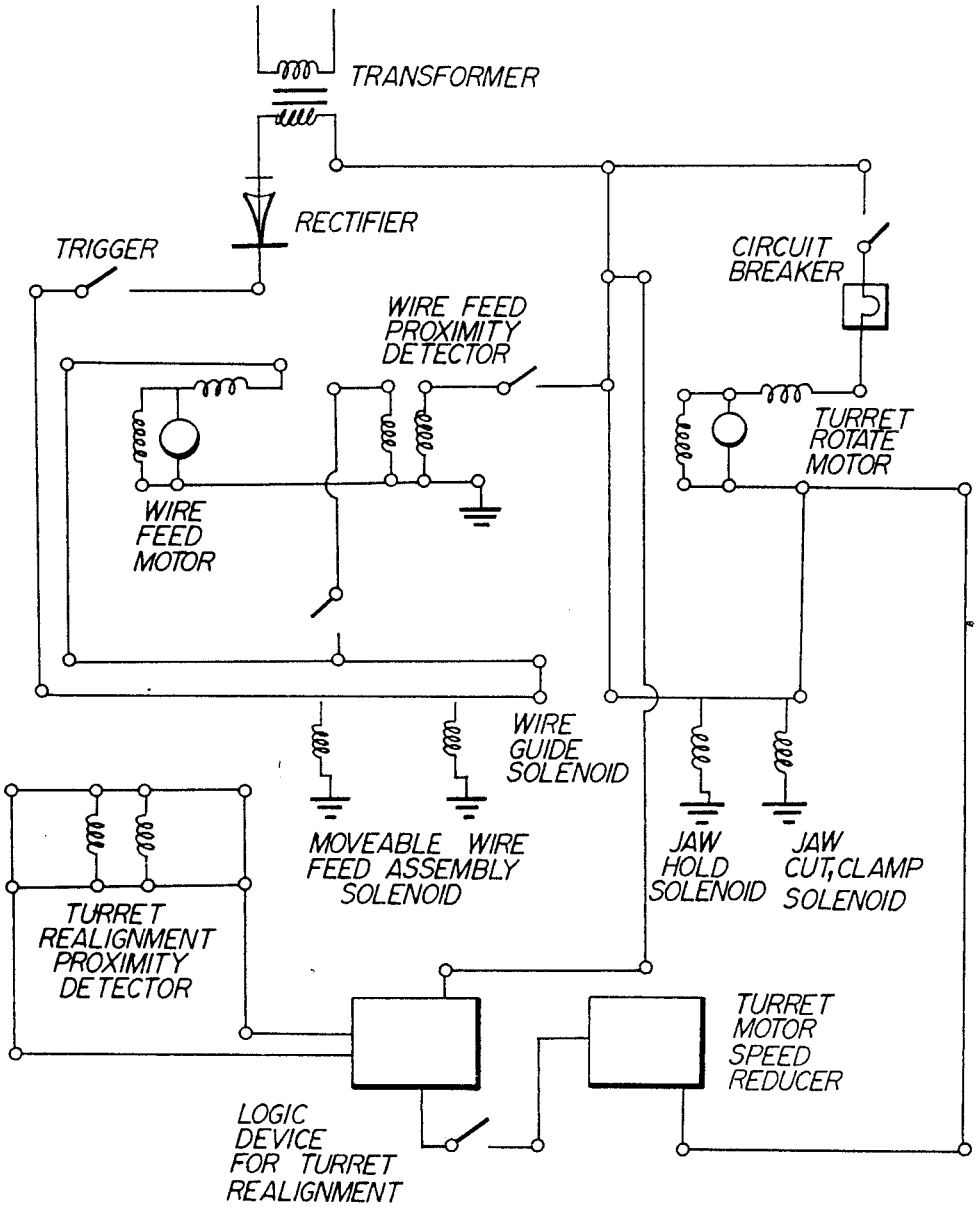
FIG. 4 Shows an electrical schematic for the control and timing circuitry of the wire tying tool.
Figure 5:
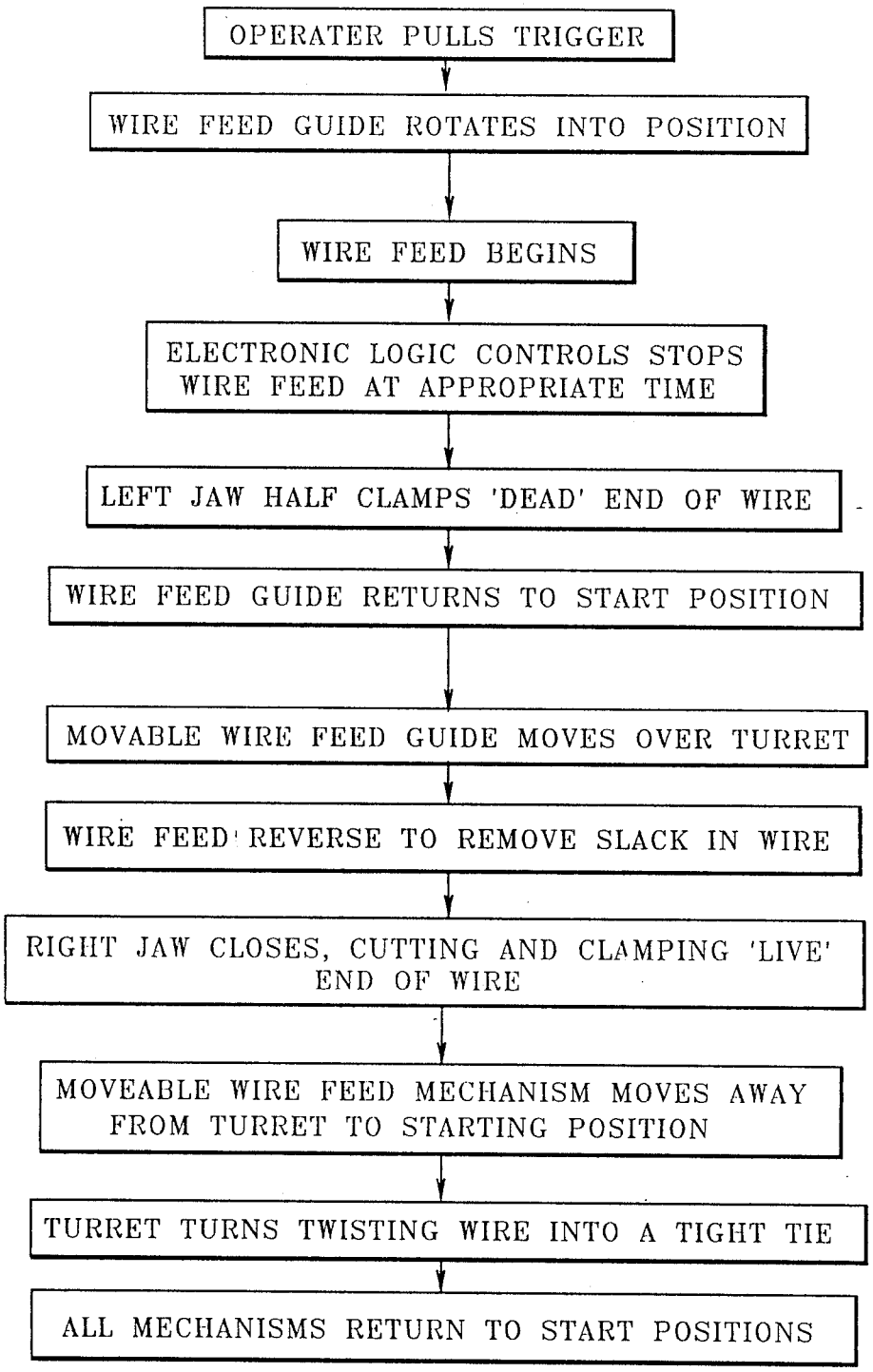
FIG. 5 Shows a sequence flow chart for operation of the various components of the wire tying tool.
Figure 8:
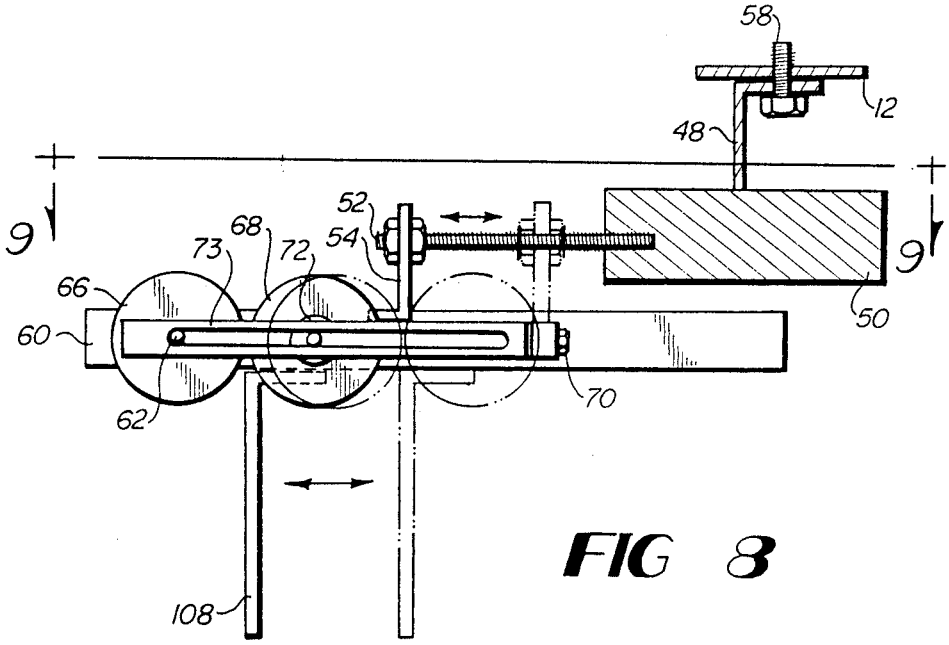
FIG. 8 Shows a partial elevation sectional view of the moveable wire feed mechanism (assembly) taken from FIG. 3. (Designated as Drawing Reference No. 78.)
Figure 9:
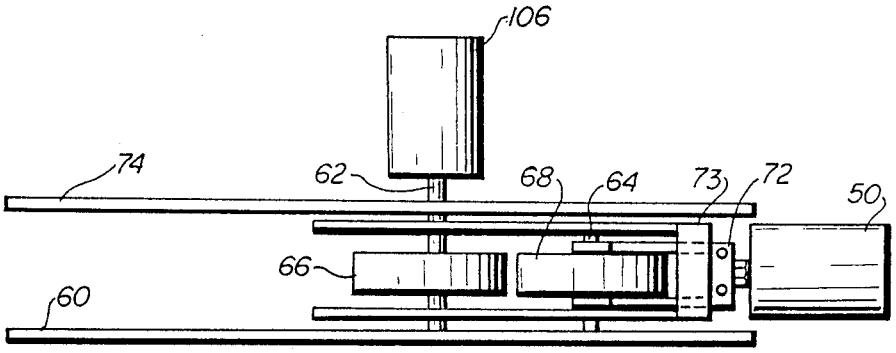
FIG. 9 Shows a top view of the assembly of FIG. 8 (Servo not shown for clarity).
Figure 12:
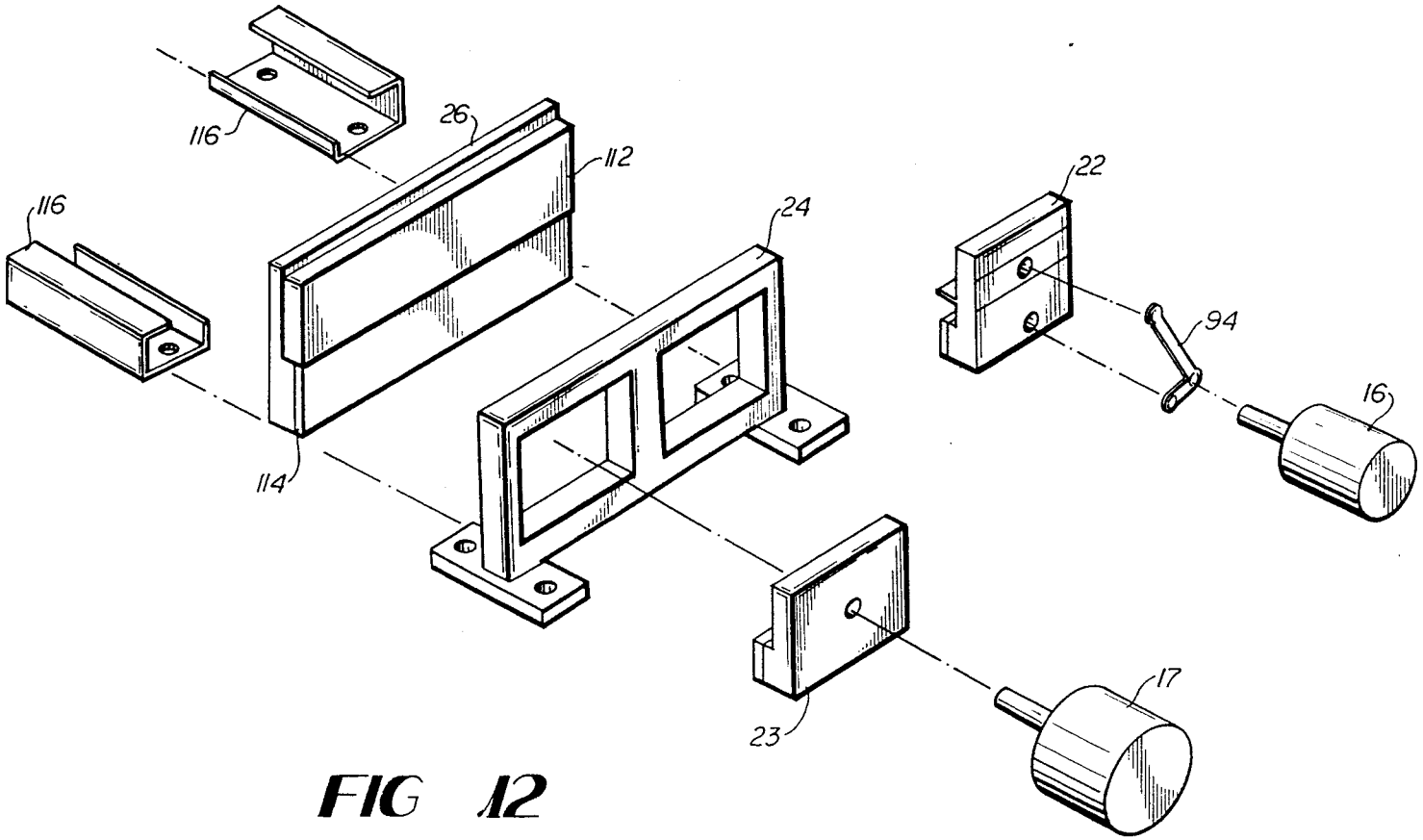
FIG. 12 Shows an enlarge exploded perspective view of the jaw assembly. (Designated as Drawing Reference No. 82.)

FIG. 1 shows the wire tying tool according to the preferred embodiment of the invention. The tool comprises two housing side covers (12 and 46) with an electric trigger mechanism (76) mounted to each half by mechanical means (not shown). Each housing side cover has a projecting flange to which the wire supply reel (14) is connected by shaft mount (30). Connected and mounted to one housing side cover is the electronic logic control circuitry (44). The various electronic and electrical components, as can best be seen schematically in FIG. 4, of the wire tying tool are connected by wire or other suitable means to this component of the invention and are not shown. Rotatably mounted to the left housing side cover at the bottom rear is the wire channel guide (42) which pivots from the idle position to the actuated position as can best be seen from FIG. 2. The gear teeth of (42) are meshed with the gear teeth of the wire channel guide rotation drive gear (28). This is in turn connected to drive motor (29). Mounted midway between 12 and 46 and projecting through the opening in the bottom of these pieces is the turret with gear teeth (38). Mounted atop the turret and annular in shape is the commutator ring (40). (38) is meshedly connected to the drive gear for turret rotation (36) which is rotatably connected to the turret gear drive shaft (34). (34) is connected to the vertically oriented drive motor for turret rotation (32). Mounted atop (38) connected by the jaw mounts (116), and within the annular space of (40) is the fixed jaw thrust head (26). Directly opposed to (26) and paralledly mounted to the bottom portion of (26) is the fixed jaw boss (24). Inside one of the rectangular hollows of (24), the moving jaw clamp and cutter head (22) inserts. (22) is pin connected to thrust rod (94) which connects to the connector shaft (18). (18) is connected by means of a pinned joint to the jaw closing solenoid (16). As can best be seen in FIG. 12, mounted directly adjacent to (16) and parallel to it is the left jaw closing solenoid (17) which connects to the left clamping head (23) by means of thrust shaft (20). (23) passes through the second rectangular void in (24) in a similar fashion to that of (22). Mounted above the turret and below the electronic logic control circuitry (44) is the moveable wire feed mechanism assembly (78) consisting of several components as can best be seen in FIGS. 8 and 9 which shows these components in sectional elevation view and top view. Left slider guide (60) and right slider guide (74) are interconnected by a solid means at each end which will allow separation and which are solidly mounted to (12) and (46) respectively. Idler shaft for wire feed driving wheel (62) and driven adjustable feed wheel shaft (64) mount inside the hollowed grooves of (60) and (74) in a perpendicular orientation to the minimal dimension. Fit around the periphery of (62) and (64) in a rotatable fashion are the flush and intangential contact vertically opposed wire feed driving wheel (66) and the driven adjustable feed wheel (68). Surrounding (66) and (68) and having parallel grooves in a rectangular guide inset between (60) and (74) is the wheel tension adjuster tray (73) to which the drive wheel pressure adjustment thrust frame (72) is threadably attached to (73) by means of the drive wheel pressure adjustment screw (70) at the one end and through which (64) passes through at it's other extreme end. Mounted above and connected by screw means to (72) is connecting flange (54). Passing through a hole in the top of (54) is the threaded adjustable connecting link (52). The one end of (52) then attaches to the moveable wire feed assembly slider solenoid (50). Above (50) is the slider solenoid mounting bracket (48) which attaches (50) to (46) by means of connecting screws (58). Mounted between (74) and (60) and extending below each is the moveable wire guide fence (108) connected by mounting screws (110). Mounted to the side of (74) and shaftably connected to (62) is the wire feed reversible driving motor (106).

Figure 3:
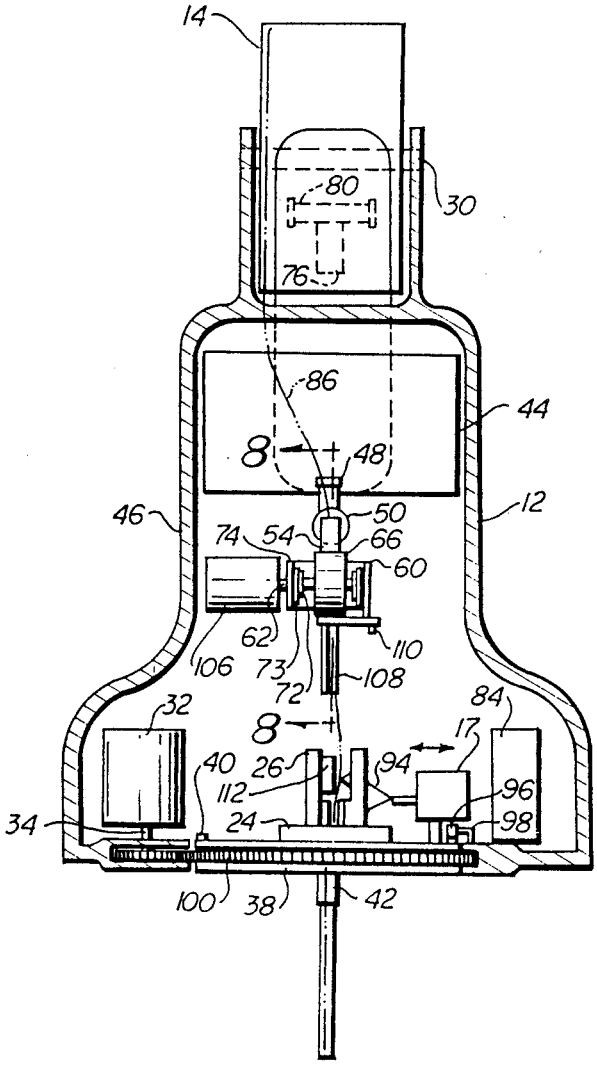
FIG. 3 Shows a front sectional view of the wire tying tool taken from FIG. 2.
Figure 6:
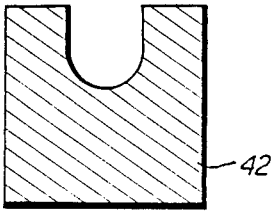
FIG. 6 Shows a sectional view of the wire channel guide from FIG. 2.
Figure 7:
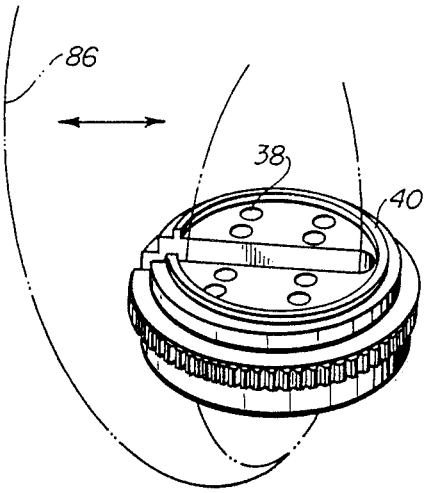
FIG. 7 Shows an enlarged perspective view of the turret component assembly with the wire path shown.
Figure 10:
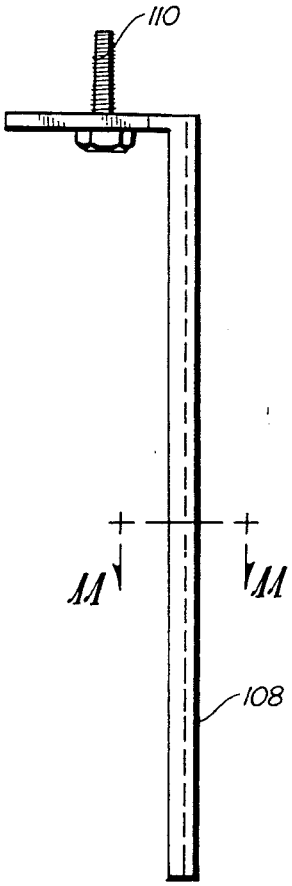
FIG. 10 Shows an enlarged elevation of the moveable wire guide fence from FIG. 8.
Figure 11:
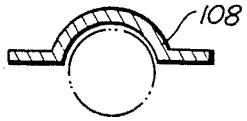
FIG. 11 Shows a sectional view of the moveable wire guide fence of FIG. 10.

Mounted near the top hollowed handle shaped portion of (12) is the electric trigger mechanism (76). The piece (76) is connected to (12) by trigger mounting shaft (80) as can best be seen in FIG. 3. As can best be seen in FIG. 3, the turret realignment flux proximity detector (84) mounts to the left and right housing side covers (12) and (46) respectively and is adjacent to (38). As can best be seen by FIG. 6, the fixed electric brush (96) is supported by mount (98), (96) is in contact with and above (40). Electrical wire connection (104) is connected between (16) and (40). As can best be seen by FIG. 10, the replaceable hardened cutter head (112) is flatly mounted to the top of vertical inside face of (26) on the side facing (22). Mounted at the bottom vertical inside faces of (22) and (26) are the parallel opposed repalceable knurled jaw grips (114).

OPERATION

Figure 2:
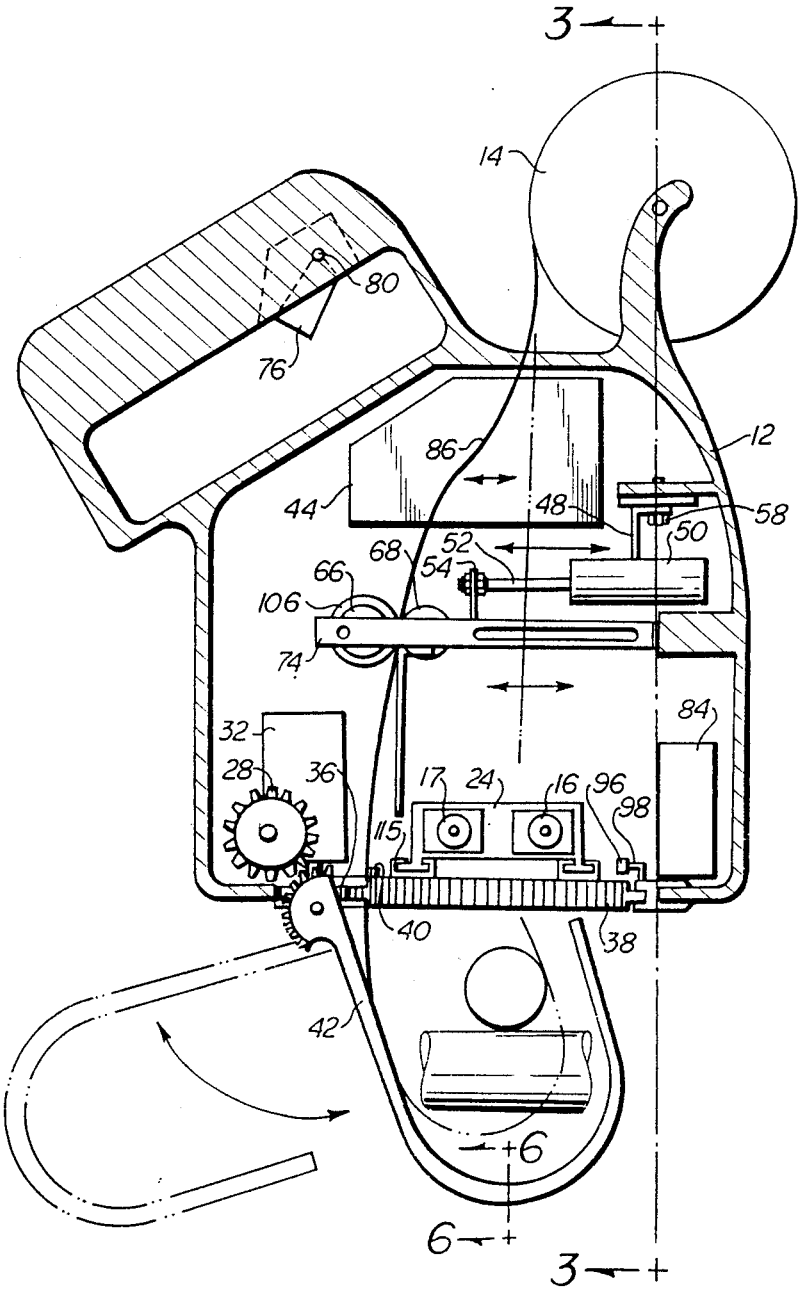
FIG. 2 Shows a sectional elevation view of the wire tool taken from FIG. 1.

The wire tying tool for concrete reinforcing steel of FIGS. 1 to 12 performs the function of automatically making wire ties about crossed or lapped steel reinforcing bars. Firstly, the operator positions the tool atop the members to be tied and then initiates the machines cycle by depressing the electric trigger mechanism (76) which pivots about the trigger mounting shaft (80). This action electrically activates drive motor (29) which is connected to wire channel guide rotation drive gear (28) causing rotation which in turn meshably engages the gear teeth of the wire channel guide (42) and causes rotation of this piece in an upward direction as can best be seen in FIG. 2. When the wire channel guide contacts the bottom of (38) rotation stops and wire feeding begins. Wire is stored on the wire supply reel (14) and feed is begun by the electronic logic control circuitry (44) activating the wire feed reversible driving motor (106) which is shaftably connected by the idler shaft for wire feed driving wheel (62). This in turn causes rotation of wire feed driving wheel (66) which sandwiches the wire being fed against the driven adjustable feed wheel (68) causing the wire to be frictionally driven downwards through the wheels. Guidance of the wire is aided by the moveable wire guide fence (108) since it steadies the wire movement and prevents kinking by aligning the wires' path by contact with it vertically. The moveable wire guide fence (108) also helps steer the wire into the top of the wire channel guide (42) and again stays in contact with the wire to prevent kinking until the wire is fed through the wire channel guide (42) and exits out of it at the end opposite the wire channel guide rotation gear and continues in an upwards direction through the opening in the turret gear (38) and continues between the fixed jaw boss (24) and the parallelably opposed fixed jaw thrust head (26). Electrical power is conveyed to the electrical components mounted on (38) by means of commutator ring (40) which is in contact with fixed electric brush (96). (96) is mounted to (46) by mount (98) which supplies support for it. (96) is connected electrically to (44) by electrical wire connector (104). When this occurs (as metered by the electronic logic control circuitry), the wire feed stops. At this point, the left clamping head (23) is moved linearly towards the fixed jaw thrust head (26) by action of the left jaw closing solenoid (17) which linearly applies force along thrust shaft (20) which contacts (23) at it's rear vertical face. When (23) contacts the fed wire, it continues along it's path until clamping pressure forces the wire against the replaceable knurled jaw grip (114). At this point, the fed wire is clamped and cannot move. At this point, the drive motor (29) reverses it's direction of rotation from it's initial directional movement and in turn reverse-rotates (28) and causes (42) to swing back to it's starting position as can be seen in FIG. 2. Now the fed wire must be moved into position so that it may be cut. This is accomplished by activation of moveable wire feed assembly slider solenoid (50) which is attached to right housing side cover (46) by means of attachment screws (58) and mounting bracket (48). Both (46) and left housing side cover (12) provide a continuous frame for attachment of the various machine components as well as serving as a protective housing to guard from dirt and debris damage. The force from (50) is linearly transmitted by means of threaded adjustable connecting link (52) which at it's opposite end is connected to connecting flange (54) which is oriented above and screwably connected to drive wheel pressure adjustment thrust frame (72) by means of screws (56). The linear motion causes (73) to move parallel to and between the left slider guide (60) and the right slider guide (74). (60) and (74) provide support for the driven adjustable feed wheel mounting shaft (64) which is in contact with the slot in (74) and at the opposite end slot in (73). (73) and (74) also provide support for idler shaft (62) which mounts in parallelably opposed holes in (60) and (74). When (73) moves linearly in the slots of (60) and (74), it also transmits linear force to the drive wheel pressure adjustment thrust frame (72) which can best be seen in FIG. 1 which moves (72) linearly over the top of (22) so that the wire feed drive wheel (66) and the driven adjustable feed wheel (68) are moved with (72) (since they are connected by shaft (62) and (64) respectively to (72)) to a position which centers the gap between (66) and (68) directly over the center and above the opening between (22) and (26). Thus since the wire feed path (86) passes between said gap, then the wire will now be between the faces of (26) and (22). Now the slack in the fed wire is removed by reversing the rotation of (106) causing reverse rotation of (66) which forces the wire in an upward direction by means of it being clamped between (66) and (68). The electronic control circuitry (44) then activates the right jaw closing solenoid (16) causing connector shaft (18) to be moved linearly toward (26). Since (18) is connected to thrust rod (94), (94) is in turn moved toward moving jaw clamp and cutter head (22). At the top and bottom of it's back vertical face, (22) connects to (94) so that (22) is forced through the rectangular shaped opening (24) and the triangular shaped cutting surface point of (22) contacts the fed wire at the top forcing it against (112) simultaneously cutting the wire at the bottom knurled front face of (22). The wire is clamped against the inside front face of (114) so that the wire cannot move. The electronic logic control circuitry (44) now deactivates (50) so that the above described motion is reversed and the moveable wire feed mechanism assembly (78) returns to it's starting position. Clamping force can be adjusted between (66) and (68) by means of the drive wheel pressure adjustment screw (70) by reaction against (72) and force transmitted through (73) to (64) pressing (68) harder against (66). The electronic logic control circuitry (44) now activates drive motor for turret rotation (32) causing rotation of turret gear drive shaft (34) which causes the drive gear for turret rotation (36) to turn and with it the jaw assembly (82) is rotated atop turret gear (38) since (36) is meshed with turret gear (38) causing it to rotate which twists the fed wire about the members being tied. When a predetermined load is reached, (16) and (17) are deactivated thus releasing clamping force from both ends of the fed wire. The jaw assembly (82) and turret gear (38) continue to rotate until the long horizontal axis of the jaw assembly is in line and parallel to the vertical plane of the wire channel guide (42) and oriented so that the cycle is ready to begin again. Wire supply reel (14) is mounted about support shaft (30). Jaw mounts (116) supply a means for connecting (26) to (38). The positioning is controlled by the turret realignment flux proximity detector (84). Thus, the reader will see that the wire tying tool for reinforcing steel of the invention provides a highly reliable, lightweight, yet economical device which can be used by any person regardless of their level of skill.

While my above description contains many specificities, these should not be construed as limitations on the scope of the invention, but rather as an exemplification of one preferred embodiment thereof. Many other variations are possible. For example, the jaw assembly (82) could be inset into the body of turret gear (38), lower than what is shown, to reduce the amount of wire used in each cycle by shortening the distance between the members being tied and the cutter head. Various sized and shaped wire channel guides (42) could be designed to accommodate different sized and shaped objects to be tied. Also, the geometrics and power of the overall machine could be adpated to accommodate various sizes of wire to be used for the tying process. Also, the motive forces could be accomplished by other than electricity. Hydraulics, pneumatics and solar electrical powers could be utilized. The device could also be non-portably base mounted. Also, the grip handles (incorporated into (12) and 46)) length could be increased to afford greater comfort to the operator.

Accordingly, the scope of invention should be determined not by the embodiment(s) illustrated, but by the appended claims and their legal equivalents.

We claim:

1. A tool for making wire ties about reinforcing bars on the like, comprising:

means for feeding a first end of the wire from a supply source with said wire remaining connected to the supply source;

means for guiding said wire around the members to be tied;

means for moving said wire from the supply source into substantially parallel alignment with said first end of said wire;

means for clamping said wire from the supply source to said first end of said wire; and means for separating said wire from the supply source.

2. A tool as defined in claim 1 in which said tool includes a power source and switch means for selectively activating said tool.

3. A tool as defined in claim 1 in which said means for feeding said wire includes a plurality of wheel means adjacent one another and adapted for receiving said wire therebetween.

4. A tool as defined in claim 1 in which said means for guiding said wire includes a pivotally mounted, curved, slotted member for guiding said wire back toward said supply source.

5. A tool as defined in claim 1 in which said tool includes a means for twisting together said wire from the supply source and said first end of said wire.

6. A tool as defined in claim 5 in which said means for twisting said wires comprises a rotatable turret having a slot means formed therein for receiving said wire from the supply source and said first end of said wire.

7. A hand held power tool for making wire ties around reinforcing bars or the like comprising, a housing means with a wire supply source mounted thereon, means for feeding wire along a path from said supply source and for guiding a first end of said wire around the members to be tied, with said wire remaining connected to said supply source, carriage means for moving the connected portion of said wire linearly toward said first end of said wire, means for securing said first end to said connected portion, and means for separating said connected portion from said supply source.

8. A tool as defined in claim 7 in which said tool includes a power source and switch means for selectively activating said tool.

9. A tool as defined in claim 7 in which said means for feeding said wire includes a plurality of wheel means adjacent one another and adapted for receiving said wire therebetween.

10. A tool as defined in claim 7 in which said means for guiding said wire includes a pivotally mounted, curved, slotted member for guiding said wire back toward said supply source.

11. A tool as defined in claim 7 in which said means for securing comprises a rotatable turret having a slot means for receiving said first end and said connected portion of said wire, the rotation of said turret twisting said first end and connected portion together.

* * * * *